US005405653A

United States Patent [19]

Hayes et al.

[11] Patent Number: 5,405,653

[45] Date of Patent: Apr. 11, 1995

[54] POLY(VINYL ALCOHOL)STARCH BLENDS FOR TEXTILE SIZES WITH IMPROVED ABILITY TO BE DESIZED

[75] Inventors: Richard A. Hayes, Houston, Tex.; George D. Robinson, Matthews, N.C.

[73] Assignee: E. I. Du Pont de Nemours and Company, Wilmington, Del.

[21] Appl. No.: 203,070

[22] Filed: Feb. 28, 1994

[51] Int. Cl.[6] ..... B05D 3/04; B05D 3/10

[52] U.S. Cl. ..... 427/341; 8/115.6; 427/342; 427/353; 427/401; 524/47; 524/53

[58] Field of Search ..... 8/115.6; 427/389.9, 427/341, 342, 353, 401; 524/53, 47

[56] References Cited

U.S. PATENT DOCUMENTS

| | | | |
|---|---|---|---|
| 3,689,469 | 9/1972 | Inskip et al. | 260/86.1 |
| 4,013,805 | 3/1977 | Corey et al. | 427/390 |
| 4,172,930 | 10/1979 | Kajitani et al. | 427/389 |
| 4,640,946 | 2/1987 | Vassallo et al. | 524/45 |
| 4,756,714 | 7/1988 | Hendrix et al. | 8/115.6 |
| 4,990,335 | 2/1991 | Bateman et al. | 424/408 |
| 5,362,515 | 11/1994 | Hayes et al. | 427/155 |

FOREIGN PATENT DOCUMENTS 75-32335 10/1975 Japan .

OTHER PUBLICATIONS

Polyvinyl Alcohol Properties And Applications; Chapter 11 pp. 365–368.

*Primary Examiner*—Michael Lusignan
*Attorney, Agent, or Firm*—Peter A. Fowell

[57] ABSTRACT

Compositions based on blends of certain specified poly(vinyl alcohol) copolymers and various starches are described which are useful as sizes, and can have improved ability to be desized from fabrics compared with the starches alone. The specific poly(vinyl alcohol) copolymers useful in the blends with the starches are copolymers having a high level of acrylic ester comonomer. The blend sizes are useful in producing woven materials since they are excellent sizes, and are uniquely adaptable to caustic desizing.

9 Claims, No Drawings

POLY(VINYL ALCOHOL)STARCH BLENDS FOR TEXTILE SIZES WITH IMPROVED ABILITY TO BE DESIZED

BACKGROUND OF THE INVENTION

1. Field of the Invention

This invention relates to compositions useful for textile sizes, based on blends of particular poly(vinyl alcohol) copolymers with starches, and to the process of weaving textile fabrics which employs the compositions as sizes and utilizes their ready ability to be desized. The sizes are based on copolymers having a high level of acrylic ester comonomer, blended with various starches. Desizing involves use of caustic solutions and is ideally suited to such compositions.

2. Background of the Invention

Poly(vinyl alcohol) homopolymers, and certain poly(vinyl alcohol) copolymers have been known for use as textile sizes for many years. For convenience, both will be generically referred to hereinafter as PVA(s) or PVA polymers. When specificity requires they will be referred to as PVA homopolymers or homopolymer PVA and PVA copolymers or copolymer PVA. By convention, homopolymer PVA includes PVA derived from homopolymer poly(vinyl acetate) which has been only partially hydrolysed as well as that which has been 'fully' (>98%) hydrolysed. The terms 'fully hydrolysed PVA homopolymer' and 'partially hydrolysed PVA homopolymer' will be used when distinction is necessary. It is also possible to have fully or partially hydrolysed PVA copolymers though most copolymers are fully hydrolysed.

These different PVAs differ quite significantly in properties as textile sizes and in the ability of fabrics sized with them to be desized. This difference primarily depends on the degree of hydrolysis and the comonomer content, but also on other factors including molecular weight and thermal history.

PVAs are commonly prepared by alcoholysis of the corresponding poly(vinyl acetate) homopolymer or copolymer. The process is often (though not strictly correctly) referred to as hydrolysis; hence the term 'partially hydrolyzed' when not all the acetate groups are completely converted to alcohol groups. When homopolymer poly(vinyl acetate) is only partially hydrolysed, the resulting PVA is really a vinyl alcohol/vinyl acetate copolymer. However, as noted, such polymers are generally referred to as PVA homopolymers. The term copolymer in this regard is reserved for materials which result from hydrolysis of the corresponding vinyl acetate copolymer, i.e. polymer also containing units derived from a monomer other than vinyl acetate.

Fully hydrolysed PVA homopolymer is highly crystalline, and strong, but because of its high crystallinity it dissolves only in hot, not cold water. Furthermore, when it is subjected to high temperatures, it can develop even higher levels of crystallinity than as prepared, resulting in polymer which is even more difficult to dissolve. Finishing mills with certain fabrics, particularly blend fabrics, tend to use a heat setting condition to relieve fiber stress. The treatment is typically carded out at temperatures which develop further crystallinity in fully hydrolysed PVA homopolymer, so that when such polymer is used as size on fabric, the treatment causes an increase in its crystallinity and a decrease in ease of subsequent desizing.

PVA copolymers and partially hydrolysed PVA homopolymers are less crystalline, and dissolve at lower temperatures, or more rapidly at a given temperature. As a result they desize in water more readily, and are less subject to change in crystallinity and ability to be desized with fabric heat-setting treatments. For a given level of comonomer or residual unhydrolyzed acetate units however, the two types of PVAs are not identical in several respects. This is partly because the distribution of comonomer units (or units derived from them by lactonization, as discussed below) along the polymer chain is not the same as the distribution of residual acetate units along the chain after partial hydrolysis.

Various PVA copolymers have been disclosed as being useful for textile sizes. U.S. Pat. No. 3,689,469 (Inskip et al.) discloses PVA copolymers with 2 to 6.5 weight percent methyl methacrylate as comonomer which are useful as textile sizes, and compares their properties as sizes with fully hydrolysed and partially hydrolysed PVA homopolymer. The disclosure also indicates however, that above about 6 weight percent methyl methacrylate such copolymers are excessively water soluble.

PVA copolymers containing 1 to 10 mole percent methyl acrylate or methyl methacrylate as comonomer are disclosed in U.S. Pat. No. 4,990,335 (Bateman et al.). (For methyl acrylate this corresponds to about 2 to 16 weight percent methyl acrylate in the polymer, calculated as non-lactonized vinyl alcohol copolymer). The polymers are disclosed as being useful for certain tableting applications. There is no suggestion for use of such polymers as a textile size.

Japanese Patent No. 75-32355 discloses modified poly(vinyl alcohol) polymer fiber sizing agents containing 0.1 to 15 mole % lactone rings. In an example, cotton fabric sized with a 4.7 mole % lactone polymer prepared by saponifying (hydrolyzing) a poly(vinyl acetate/methyl acrylate) copolymer with 4.5% methyl acrylate (which corresponds to 4.7 mole % lactone when the comonomer is fully lactonized, and to about 8.1 weight percent methyl acrylate calculated as non-lactonized vinyl alcohol copolymer) had better scouring fastness than homopolymer PVA.

U.S. Pat. No. 4,172,930 (Kajitani et al.) discloses a PVA copolymer as textile size where the comonomer is 0.1–10 mole percent of a diacid such as maleic and fumaric acids, but having no monoester, diester or anhydride of the diacid. Copolymers containing free acid can be extremely water sensitive.

Many other materials are known for use as textile sizes. Unmodified starches are inexpensive, but they do not generally have as good properties as PVAs, often flaking off the yarn when used as sizes. They do not give stable solutions, and often desizing requires use of enzymes. Many modified starches are known which are improvements in various ways over simple starches, but may be considerably more expensive. Polyacrylic sizes are also known and have good properties, but are extremely water sensitive. Known PVA based sizes may be considered to have, very generally, sizing properties intermediate between starches and polyacrylic sizes.

Blending different sizing materials is known and used. Blending can provide properties of the size itself, and economics, intermediate between those of the components. Heretofore however, PVA copolymers containing above 6.5 weight percent ester comonomer have not been considered as components of blend sizes. Nor has blending as a means of enhancing ability to be desized heretofore been considered.

Desizing usually involves water washing. However desizing of particular polymers using caustic solution is sometimes used and has been described. U.S. Pat. No. 4,013,805 (Corey et al.) discloses a poly(vinyl acetate) copolymer which contains a comonomer with free carboxylic acid groups derived from a monomer such as acrylic acid, which can be desized with aqueous base. The poly(vinyl acetate) copolymer is not hydrolysed to the corresponding poly(vinyl alcohol) copolymer.

Desizing of wax-free PVA polymer or copolymer sizes, where the copolymer may contain up to 6 weight percent methyl methacrylate or other comonomers, and wherein the size contains an alcohol ethoxylate surfactant, using an alkaline scour bath followed by hot water rinses, is disclosed as being easy compared with comparable sizes with wax but no surfactant, in U.S. Pat. No. 4,640,946 (Vassallo et al.).

Solubility and dissolution times of various types of PVA in water and caustic solutions are discussed in 'Polyvinyl Alcohol', John Wiley & Sons Ltd., 1992, Chapter 11, p365–368. It is noted there that partially hydrolysed PVA homopolymer dissolves more slowly in caustic solutions than in water, whereas PVA copolymers with methyl methacrylate as comonomer dissolve more rapidly in caustic than in water. This is explained by the fact that caustic further hydrolyses partially hydrolysed PVA to homopolymer, whereas with the copolymer, lactone tings known to be present are saponified, resulting in ionic groups which are highly soluble. The methyl methacrylate copolymers discussed were designated T-25 and T-66. The amounts of methyl methacryate in those copolymers were not disclosed. Those polymers are manufactured by E. I. du Pont de Nemours. They both contain less than 6.5 weight percent methyl methacrylate, calculated on the basis of non-lactonized poly(vinyl alcohol) copolymer.

The whole chapter in the above reference provides a general background to use of PVA copolymers and other materials in sizing applications.

Ease of desizing can strongly affect the economics of the weaving process. Many starches and modified starches are known for use as sizes. Each has a particular niche. Many are not readily de sized, do not have particularly good properties as sizes, and do not provide very stable solutions. There remains a need for sizes which have acceptable mechanical properties, give relatively stable size solutions, yet which have acceptable water insensitivity. A size material which can be used to upgrade starch size properties, but particularly to upgrade the ability to be desized, by utilization of such a material in blends with starch remains a strong need.

SUMMARY OF INVENTION

The invention concerns improved sizing compositions which are blends of PVA copolymers containing a very high level of an ester comonomer and various starch materials. The blends are effective sizes. They are used as aqueous sizes. Fabrics sized with these blends are able to be very effectively desized compared with many starches alone.

More particularly, the present invention provides a composition which is useful in aqueous solution as a size comprising:

a) from 10 to 90 parts of a poly(vinyl alcohol) polymer which is a poly(vinyl alcohol) copolymer containing from about 7 to 15 weight percent units derived from an alkyl acrylate or methacrylate or a dialkyl fumarate or maleate, wherein the alkyl group contains from 1 to 8 carbon atom, and b) from 90 to 10 parts of a starch sizing material.

The invention further provides a process to produce woven textile materials where yarn is sized with the above blended size materials, and after weaving, the size is removed from the woven textile fabric with a dilute caustic solution, and optionally, the caustic desized fabric is further washed with water.

DETAILED DESCRIPTION OF THE INVENTION

In this disclosure, it should be understood that the use of the term comonomer, when referring to PVA copolymers, as used here and as conventionally used, refers to the comonomer copolymerized in the poly(vinyl acetate) copolymer before the latter is converted to a PVA by alcoholysis. In PVA copolymers, ester comonomer units are subject to reactions with a hydroxyl from an adjacent vinyl alcohol unit to form lactones, and free alcohol from the ester unit. Thus the original ester monomer unit may no longer exist as the same entity as was present in the precursor poly(vinyl acetate) copolymer. Almost complete lactonization may occur, though the extent may vary with different comonomers. The use of phrases such as PVA copolymers 'with' or 'containing' a given comonomer and the like should be understood in this context.

PVA copolymers containing up to 15 mole % lactone tings have been disclosed generally as sizing materials. Commercially, PVA copolymers containing up to about 5 weight percent methyl methacrylate have actually been used for textile size compositions. Above 6 weight percent of methyl methacrylate has been considered the useful upper limit, since, as noted above, higher levels were considered to make the polymers highly water sensitive.

Surprisingly, PVA copolymers with comonomer levels even above 7 weight percent of certain acrylate, methacrylate and certain other comonomers are suitable as textile sizes. This is because they have a major advantage over previous sizing compositions in that they have now been found to be particularly easy to desize if, instead of the usual water as desizer, dilute caustic solutions are used. In addition, presumably because such copolymers have low crystallinity and crystallize less readily, the ability to desize using caustic solutions is far less affected by heat treatment than for copolymers containing less ester comonomer.

The starches which can advantageously have blended with them the high ester PVA copolymers described to improve their ability to be desized and, in general, to improve their behavior as sizes include natural starches, synthetic starches and some chemically modified starches. There are some starch derived materials which have been so modified that they are far removed in properties and ability to be desized, and are not particularly advantageously blended with the high ester PVA copolymers. Some modified starches for instance are already fairly readily desized and/or have properties far removed from natural starches. Indeed such materials may already be so modified that their modification alone may serve a similar purpose of improving sizing behavior and ability to be desized, and blending with the high ester PVA copolymers of the invention provides only a modest additional advantage.

Nevertheless a sizing property advantage will generally occur even with highly modified starches. The starches which are blended advantageously with the high ester PVA copolymers in this invention are preferably natural starches or synthetic starches which have not been modified or have been modified to only a small extent. Any starch which is more readily desized alone with caustic than the high ester PVA copolymers may still advantageously be blended with high ester copolymer to improve properties. Such starches however are not the major focus of the present invention, even though they are included within its bounds.

Natural starches are carbohydrates of natural vegetable origin which are commonly considered to be composed mainly of amylose and/or amylopectin. Specific examples of naturally-occurring starches include those of corn, wheat, potato, sorghum, flee, bean, cassava, sago, tapioca, bracken, lotus, water chestnut, and the like. These are the starches which are the preferred size materials of the invention because they will be substantially upgraded in their ability to be desized, and because in general, their properties as sizes are poorer than modified starches. Their main advantage is that they are relatively inexpensive.

Examples of synthetic starches and chemically or physically modified starches include alpha starch, fractionated amylose, moist heat treated starch and the like, enzymatically modified starches such as hydrolyzate dextrin, dextrin produced by enzymatic degradation, amylose and the like, chemical degradation-modified starches such as acid-treated starch, hypochlorite-oxidized starchdialdehyde starch and the like, chemically modified starch derivatives such as esterified starches. Specific examples of chemically-modified starch derivates include esterified starches such as starch acetate, starch succinate, starch nitrate, starch phosphate, starch urea phosphate, starch xanthate, starch acetoacetate; etherified starches such as allyl etherified starch, methyl etherifired starch, carboxymethyl etherified starch, hydroxyethyl etherified starch, hydroxypropyl etherified starch; cationized starches such as the reaction product from starch and 2-diethylaminoethyl chloride, the reaction product from starch and 2,3-epoxypropytrimethylammonium chloride; crosslinked starches such as formaldehyde-crosslinked starch, epichlorohydrin-crosslinked starch, phosphoric acid-crosslinked starch and the like, and any mixture of any of the above or similar starches.

The chemical nature and solubility characteristics in water and caustic solutions of PVA copolymers containing an ester comonomer has been recognized in a general qualitative way. Heretofore however, it had not been recognized that a major divergence in solubility characteristics between water and caustic solubility occurs when high ester comonomer levels are present, i.e., above about 6%). More importantly, it had not been recognized that such a divergence presents an ideal situation for utilization of such copolymers as sizes, either alone, but particularly in blends with size materials such as starches, because such copolymers are amenable to easy desizing using caustic solutions.

Sizes based on blends of such high ester PVA copolymers with various starches are more readily desized than the starches alone. Utilization of these high ester PVA copolymers alone is the subject of a copending patent application, and utilization of them with other PVA polymer size materials is the subject of a further copending application.

In general, PVA copolymers have good mechanical properties as sizes. When in addition, the de sizing advantage of high ester comonomer copolymers is taken into account, they have a place as size materials and as blending materials to aid in desizing. They can contribute both to the properties of the blend size and to the overall ease of desizing provided caustic desizing is used. In blend compositions tested, it has been found that the ease of desizing with caustic solutions is, very approximately, a weighted average of the ability to desize the blend components, rather than being limited by the least readily desized component, which is generally the starch. Thus that if a particular quality of a size material is desired—a particular property, or low cost for instance—in a starch size that is difficult to desize, then a blend with high ester comonomer containing PVA copolymer may offer an ideal compromise between cost and ability to desize, and may provide an upgrade in sizing properties per se.

PVA copolymers with acrylate and methacrylate comonomers can be prepared by well known methods which involve preparation of the corresponding poly(vinyl acetate) copolymer, followed by saponification, alcoholysis or 'hydrolysis'. Typical preparation of such poly(vinyl acetate) copolymers and their hydrolysis is given in U.S. Pat. No. 3,689,469 which describes laboratory scale preparations, and U.S. Pat. No. 4,900,335 which describes a continuous process for such polymerizations, and particularly for high ester containing PVA copolymers. The mounts of monomer are adjusted for different levels required in the polymer, and for their different reactivities. These two patents are hereby incorporated by reference.

Methacrylates are more reactive than acrylates, but both are far more reactive than vinyl acetate, so that typically they are completely reacted, while less reactive vinyl acetate has to be stripped off, and would be recycled in a commercial continuous process. Dialkyl maleates are considerably less reactive.

Suitable comonomers in the high ester comonomer PVA copolymers useful as blend copolymers in this invention are esters of unsaturated monocarboxylic acids and diesters of unsaturated dicarboxylic acids. Free carboxylic acid should not be present in the copolymers. Examples include alkyl acrylates, methacrylates, dialkyl fumarates and maleates having an alkyl group or groups containing 1 to 8 carbon atoms. Comonomer level can be from 7 to 15 weight percent calculated on the basis of non-lactonized poly(vinyl alcohol/ester) copolymers. As noted, after alcoholysis, during neutralization of the alkaline catalyst with acid, the comonomer ester group and adjacent vinyl alcohol hyroxyl groups are believed to be largely converted to lactone tings, with release of the ester alcohol. There is thus a loss of weight due to the loss of ester alcohol, but the units which are not vinyl alcohol units are lactone units, and will comprise a higher weight percent of the polymer than that of the comonomer, since an adjacent alcohol refit is involved in the lactone unit, which then has two chain carbon atoms.

To obtain above 15 weight percent ester in the poly(vinyl alcohol) copolymer, calculated on a non-lactonized basis, requires a poly(vinyl acetate) copolymer precursor which is difficult to prepare. Alkyl acrylates are preferred, and methyl acrylate is most preferred. While the decreased level of crystallinity resulting from increased comonomer levels has, in the past, been assumed to cause very high water sensitivity, (i.e. tendency to absorb water and become sticky, which can result in decreased weaving efficiency), this is not necessarily the case. Thus, very surprisingly, it has been found that a copolymer containing 9 weight percent methyl acrylate is actually less water sensitive, (dissolved less rapidly, as determined by ease of water desizing), than that a ~5.5 weight percent methyl methacryate PVA copolymer or an 88% partially hydrolysed PVA homopolymer. While not limiting ourselves to any particular theory, it is thought that methyl acrylate or other acrylates as comonomer will decrease crystallinity in the resulting copolymer less than methyl methacrylate or other methacrylates do, even if the comonomer unit becomes lactonized, because of the lack of a methyl group attached to an in-chain carbon which methyl methacrylate produces when polymerized. Alternatively, differences in the mount of lactonization may be responsible.

Different comonomers will result in varying levels of water sensitivity in the resulting copolymer. The sensitivity will depend on the reduction in crystallinity due to increasing number of comonomer units (or derived lactone units), but will also depend on the net decrease in polarity with increasing comonomer level. While long alkyl chain alkyl acrylates and methacrylates are less polar than short alkyl chain ones, PVA copolymers of long chain acrylates and methacrylates, on lactonization may contain the same in-chain lactone group as that from any other acrylate or methacrylate copolymer respectively. However, methacrylate derived lactone rings will not be the same as acrylate derived lactone rings. In addition, the amount of lactonization may vary. In any event, any copolymer can be expected to have a water sensitivity which is a balance due to the amount of reduction in crystallinity the comonomer or derived lactone causes, and the overall decreased polarity of the copolymer with increasing comonomer or derived lactone content. All the ester comonomers and the lactone ting they can form, will be less polar and hence less water sensitive than vinyl alcohol units.

While methacrylate comonomer PVA copolymers are less favored as blending components in the blend sizes of this invention, even here, as the comonomer level is increased significantly, decreased polarity in the copolymer will result. At very high comonomer levels, decreasing polarity will eventually override the increasing water sensitivity which results from decreasing crystallinity. The major advantage of ready desizing at high ester comonomer levels can make high comonomer level methyl methacrylate as well as acrylate PVA copolymers useful. Such copolymers will be particularly useful as blend components to improve overall desizing of starch sizes which are difficult to desize and will generally upgrade the size behavior of the starch.

Sizing may be carded out using solutions of the PVA copolymer and PVA polymer blend having a total polymer concentration of from 1 to 20 weight percent, preferably from 4 to 12 weight percent. The sizing composition may incorporate other materials typically found in prior art sizing compositions. Such materials may include waxy-type lubricants, defoaming surfactants, and other surfactants. A skilled artisan will be able to judge what concentration size solution to use to achieve his desired size add-on level, and what additives are best suited to his operations.

Desizing of sized fabrics is commonly carried out using water washing at varying temperatures. Surprisingly, it has been found that with the high ester comonomer levels of the PVA copolymers of the present invention, desizing can be carded out effectively with caustic solutions, and those caustic solutions can be very dilute. PVA homopolymers, and many PVA copolymers with lower levels of comonomer than the high ester copolymers of this invention, desize either less rapidly, or require higher temperatures and/or higher caustic concentrations for the same amount of desizing and will provide little added benefit in terms of ability to desize, if they are used as components of blend sizes with starch.

Caustic desizing solutions can be as dilute as about 0.001 weight percent, particularly if somewhat elevated temperatures are used to desize, though concentrations above 0.05 weight percent will more often be required. Generally, more rapid, lower temperature or more complete desizing is possible as the concentration is increased. Usually, the caustic will have to be subsequently washed out, so that higher concentration caustic than is adequate should be avoided. The caustic desizing solutions should have, at the most, a concentration of 10 weight percent. Preferably however, they should be below 2 weight percent, and most preferably between 0.1 and 1.5 weight percent. For any particular PVA copolymer size or PVA copolymer blend size, add-on level, fabric heat treatment, a suitable concentration for the desizing caustic solution and a suitable temperature for desizing can be readily determined when it has been decided how rapidly and how completely desizing is required. Thus the emphasis may be on the most rapid desizing for economic reasons. Or the emphasis may be on as low temperature desizing as possible because the textile material is somewhat temperature sensitive. Generally, almost complete desizing is required. There will not be just one caustic concentration and one temperature which is suitable, but a range of alternatives. Suitable caustic materials include any of rite alkali metal hydroxides or carbonates, i.e. sodium, potassium or lithium, with sodium hydroxide being preferred. Carbonates have been found to desize the copolymers and copolymer blends of the invention much less efficiently, though more efficiently in general than water. In some mills however, conditions may necessitate milder desizing. When this is the case, carbonates can be used, and adjustments made in concentration and time and temperature of desizing.

It is important to recognize that, while sizes made from the high ester PVA copolymers alone or even the blend sizes of this invention, desize more rapidly and effectively in caustic than many starches, they may desize less effectively when normal (aqueous) desizing is employed. This will depend on the particular starch however. Less ready water desizing can be a significant advantage, since materials which do not desize readily in water will be less water sensitive and, in general, may have less tendency to become sticky in moist environments. Of course, this does not mean that the blends of the invention can not be desized with water. However, longer times and or higher temperatures will be necessary than with cautic desizing.

The compositions and process of this invention are applicable to any conventional yarn. The textile may be woven from either spun fiber yarn or filament yarn, and may be woven from hydrophilic yarn such as cotton or hydrophobic yarns such as nylon or polyester or may be woven from combinations of hydrophilic and hydrophobic yarns. The sizes are also useful on textiles after weaving for certain finishing processes. They may also be useful for certain finishing processes for fabrics which are not woven, such as knit fabrics.

The high ester copolymers used in the process of this invention may also be adaptable for uses as films such as agricultural mulch films, biodegradable packaging films, water soluble films, and for use as hot melt adhesives, binders and the like.

The high ester PVA copolymer itself may have a 4% solution viscosity from 1 to 60 centipoise. Preferably this viscosity should be between 3 and 25 centipoise. The skilled artisan will be able to determine the optimum polymer viscosity, polymer size concentration, and add-on level for the particular yarn, fabric and weaving conditions he is using.

The blend used to prepare the size solution may contain from 10 to 90 weight percent of the high ester PVA copolymer and from 90 to 10 weight percent of the starch. Preferably, however, there should be at least about 30 percent of the high ester PVA copolymer in the PVA copolymer/starch blend used for the size.

EXAMPLES

PVA polymers other than the high ester comonomer PVA copolymer which is a components of the blends of this invention were tested for comparative purposes, either alone or blended with starches. All the starches, the high ester PVA copolymer and the other PVA polymers used in comparative testing are listed in Table I. Size solutions were made from these materials or blends of these materials, having a concentration of 8 weight percent total solids size material, by mixing them with water at about 90 deg. C., mixing for about 2 hours. The size solutions were generally translucent for starch and starch blend sizes and clear for sizes not containing a starch. When blend sizes were tested, the blends contained 50 weight percent of each component. The sizes used are listed in Table II.

Sized fabric samples were prepared as follows. Approximately 2 inch by 2 inch squares of a 7 ounce, all cotton, bleached, duck fabric type 464 obtained from Test Fabrics Inc. were first weighed, then soaked in the aqueous size for about 2 minutes at about 35 deg. C., mixing gently. The samples were then dried by placing on aluminum foil, treated with Teflon lubricant to prevent sticking, at 50 deg. C. in a convection oven for 17±1 hours. They were then cooled in a calcium sulfate desiccated box, and reweighed to determine the amount of size added on. In some cases the samples were heat-treated by placing in a convection oven at 140 deg. C. for 10 minutes.

Desizing tests were carded out by soaking the sized fabric sample in 100 grams of the test desizing medium, (either water or caustic) for 10 minutes with gentle mixing. In some instances when water was used, the sample was further desized by soaking in another 100 grams of water for 10 minutes. In all instances when caustic was used, the sample was subsequently soaked in 100 grams of water for 10 minutes. This subsequent water treatment washes out the caustic as well as providing for slight further desizing. The desized or partially desized samples were then dried in a convection air oven at 140 deg. C. for 1 hour and then allowed to cool in a calcium sulfate desiccated box. Details, are shown in the Tables IIIA and IIIB.

When examples of blend sizes of the invention are shown in the Tables, they are given a number without a prefix C. When examples of sizes outside the compositions of the invention are listed, whether from a single starch or PVA polymer or from a blend which does not include a starch and the high ester PVA copolymer, they are labeled with a prefix C, indicating they are shown for comparison. The process of the invention includes a caustic desizing step. Examples which illustrate the process of the invention are shown with an asterisk (*).

While complete desizing is generally considered necessary, the percent desizing in the examples is considered to be an indication of the ease of complete desizing. If the value shown is less than 100%, then longer desizing times, different caustic concentration or somewhat higher temperatures would be necessary to achieve complete desizing. Examples C16–C20 and example 10 which are samples which have undergone a double water wash, show that a double water wash (equivalent to longer desizing times) continues to increase the amount of desizing. The amount of de sizing after a double wash follows the same order for each size, respectively, in those tested.

Table IIIA shows the effect of desizing starches, various PVA polymers including the high ester PVA copolymer, and various blends of these, including the blends of the invention, in water. In some examples the sized fabrics were heat treated, and some were subjected to a double water wash. The advantage of the compositions of the invention is that they can be advantageously desized with caustic solutions. Tests in water form a reference base for various starches, copolymers and blends of them. The examples without a prefix C show that in water, blending starches with high ester PVA copolymer produces little or no advantage. Only by utilization of caustic desizing does blending display it advantage in ability to desize. The high ester PVA copolymer size (C) is not particularly readily desized, as can be seem for examples which have a C under the 'size' column. Comparison of comparable sized materials which have and have not undergone heat treatment show that heat treatment tends to reduce water desizability with PVA copolymers, but the starches examined (A, F, J and L sizes) are less affected by heat treatment.

These experiments emphasize that with water desizing, blending is no advantage. The advantage comes only when caustic desizing is used. The experiments also emphasize that water sensitivity also would not increase significantly in the blend examples shown.

Table IIIB shows similar samples subjected to caustic desizing, followed by a water wash. They demonstrate the complete difference in behavior between water desizing and caustic desizing. They also demonstrate how addition of high ester comonomer PVA copolymer to various starches improves the overall rate of desizing. Yet as table IIIA demonstrated, water sensitivity is not increased in general, as shown by no little to no improvement in water desizing by use of blending with high ester PVA copolymer.

Examples for starches alone (sizes A, F, J and L) show that starches themselves are advantageously de sized with caustic, particularly with increasing concentration (see Examples C36–38 compared with comparable water desizing), and that one modified starch (size J, an oxidized carboxymethyl starch ether) is completely desized with only 0.1% sodium hydroxide. Natural starch is only moderately readily desized in 0.1% sodium hydroxide (Example C21). Clearly some starches are not particularly in need of blending and caustic desizing. However, there remain many that are. A careful comparison of desizing amounts for starches alone, S1, S2 and S4 (sizes A, F and L) with blends of those starches with high ester PVA copolymer (sizes E, I and M, which are the examples with an asterisk) will show that for dilute caustic solutions, whether the samples have been heat treated or not, blending increases the amount of material desized under the test conditions. By comparison, blending with other lower comonomer content PVA copolymers (sizes D and H) does not produce such a high level of desizing. At high caustic concentrations, even starch S2 (size F) is completely desized with caustic. However, lower caustic concentration is preferred, and S2 is advantageously desized by blending with high ester PVA copolymer at lower caustic concentrations.

While all starches can be advantageously blended with the high ester PVA copolymer tested without increasing water sensitivity, (based on water desizing tests shown in Table IIIA), many, but not all starches are advantageously blended to achieve improved desizing. However, there will be no significant disadvantage in ability to desize even those starch blends which show no advantage in desizing ability, and generally there will be an improvement in the behavior of the size per se particularly in such behavior as yarn adhesion. It is within the skill of the artisan to determine in simple desizing tests, which starches do not desize very readily, even in dilute caustic solutions, and hence which are advantageously blended for use as sizes which can be readily desized. Generally, inexpensive natural sizes are particularly advantageously blended in the manner described for this invention. In general, the strength of caustic most suitable will depend on the particular blend, and can be readily determined by a few experiments.

TABLE I

STARCH AND PVA SAMPLES TESTED

| Code | Solution Viscosity | Mole Percent Hydrolysis | Composition Description |
|---|---|---|---|
| C3M | 24.32 | 99.0–99.8 | Fully hydrolysed copolymer, 3.3–4.3% MMA |
| C5M | 12–15 | 98.0–99.8 | Fully hydrolysed copolymer, 5.0–6.0% MMA |
| C9A | 15–21 | 98.0–99.8 | Fully hydrolysed copolymer, 8.5–10.5% MA |
| S1 | | | Natural corn starch, Tradename: Clin-Link692B ADM Corn Processing Co., Clinton, Iowa CAS Number: 68412-30-6 |
| S2 | | | Chemically modified starch: hyroxyethyl starch ether: Penford Gum 260 Penford Products Co., Cedar Rapids, Iowa. CAS No.: 9005-27-0 |
| S3 | | | Chemically modified starch: oxidized carboxymethyl starch ether: Astrogum 3010. Penford Products Co., Cedar Rapids, Iowa CAS No.: 9063-38-1 |
| S4 | | | Chemically modified cornstarch: ethoxylated starch ether: Clinton 712D. ADM Corn Processing Co., Clinton, Iowa CAS No.: 68512-26-5 |

Polymer code designations summarize the nature of the composition; C for Copolymer, M for methyl methacrylate comonomer, and A for methyl acrylate comonomer. Numbers 3, 5 and 9 in PVA codes refer to approximate comonomer level rounded to whole number.

Solution Viscosity in Centipoise, measured on a 4 weight percent solution at 20 deg. C., determined by Hoeppler falling ball method, bond dry basis.

All PVA samples have a pH between 5 and 7.

PVA polymer samples have a maximum ash level of 0.7 weight percent calculated as sodium oxide, dry basis.

Comonomer level in copolymer is weight percent, calculated as non-lactonized comonomer unit in the poly(vinyl alcohol) chain.

Comonomer abbreviations:

MMA=methyl methacrylate

MA=methyl acrylate

TABLE II

COMPOSITION OF SIZES TESTED

| SIZE | COMPOSITION |
|---|---|
| A | 8% aqueous mix of S1 |
| B | 8% solution of C3M |
| C | 8% solution of C9A |
| D | 8% aqueous mix of 50/50 S1/C3M |
| E* | 8% solution of 50/50 S1/C9A |
| F | 8% aqueous mix of S2 |
| G | 8% solution of C5M |
| H | 8% aqueous mix of 50/50 S2/C5M |
| I* | 8% aqueous mix of 50/50 S2/C9A |
| J | 8% aqueous mix of S3 |
| K* | 8% aqueous mix of 50/50 S3/C9A |
| L | 8% aqueous mix of S4 |
| M* | 8% aqueous mix of 50/50 S4/C9A |

*Sizes used in Examples of Invention. Other sizes are for comparative purposes

TABLE IIIA

WATER DESIZING TESTS

| Ex # | Size | Heat Trtment Y/N | Size Weight (grams) | Desize Solution | Desize Temp. Deg. C. | Percent Size Removed |
|---|---|---|---|---|---|---|
| C1 | A | N | 0154 | Water | 22 | 44.6 |
| C2 | F | N | .278 | Water | 22 | 27.7 |
| C3 | J | N | .141 | Water | 22 | 76.5 |
| C4 | L | N | .199 | Water | 22 | 37.3 |
| C5 | B | N | .223 | Water | 22 | 29.7 |
| C6 | G | N | .171 | Water | 22 | 51.9 |
| C7 | C | N | .207 | Water | 22 | 36.6 |
| C8 | D | N | .182 | Water | 22 | 38.5 |
| C9 | H | N | .161 | Water | 22 | 48.2 |
| 1 | E | N | .254 | Water | 22 | 35.9 |
| 2 | E | N | .198 | Water | 80 | 80.0 |
| 3 | K | N | .200 | Water | 22 | 55.6 |
| 4 | M | N | .162 | Water | 22 | 54.8 |
| C10 | A | Y | .130 | Water | 22 | 49.1 |
| C11 | F | Y | .222 | Water | 22 | 23.8 |
| C12 | J | Y | .154 | Water | 22 | 53.4 |
| C13 | L | Y | .165 | Water | 22 | 33.9 |
| C14 | B | Y | .217 | Water | 22 | 15.6 |
| C15 | C | Y | .223 | Water | 22 | 23.5 |
| 5 | E | Y | .184 | Water | 22 | 32.0 |
| 6 | I | Y | .232 | Water | 22 | 22.9 |
| 7 | K | Y | .219 | Water | 22 | 39.7 |
| 8 | M | Y | .190 | Water | 22 | 33.1 |
| 9 | E | Y | .201 | Water | 80 | 78.4 |
| C16 | A | N | .135 | Water/ Water | 22 | 47.1 |
| C17 | F | N | .186 | Water/ Water | 22 | 36.5 |
| C18 | C | N | .272 | Water/ Water | 22 | 53.1 |
| 10 | I | N | .183 | Water/ Water | 22 | 43.5 |
| C19 | A | Y | .146 | Water/ Water | 22 | 43.6 |
| C20 | F | Y | .238 | Water/ Water | 22 | 34.1 |

TABLE IIIB

| Ex. | Size | Heat Trtment Y/N | Size Weight (grams) | CAUSTIC DESIZING TESTS Desize Solution | Desize Temp Deg. C. | Percent Size Removed |
|---|---|---|---|---|---|---|
| C21 | A | N | .138 | .1% NaOH/Water | 22 | 58.7 |
| C22 | F | N | .251 | .1% NaOH/Water | 22 | 49.8 |
| C23 | J | N | .131 | .1% NaOH/Water | 22 | 106.1 |
| C24 | L | N | .193 | .1% NaOH/Water | 22 | 71.9 |
| C25 | B | N | .165 | .1% NaOH/Water | 22 | 38.8 |
| C26 | C | N | .356 | .1% NaOH/Water | 22 | 92.1 |
| C27 | D | N | .148 | .1% NaOH/Water | 22 | 69.9 |
| 11* | E | N | .187 | .1% NaOH/Water | 22 | 91.8 |
| 12* | I | N | .214 | .1% NaOH/Water | 22 | 89.0 |
| 13* | K | N | .162 | .1% NaOH/Water | 22 | 106.9 |
| 14* | M | N | .224 | .1% NaOH/Water | 22 | 87.1 |
| C28 | A | Y | .143 | .1% NaOH/Water | 22 | 60.8 |
| C29 | F | Y | .184 | .1% NaOH/Water | 22 | 59.5 |
| C30 | L | Y | .190 | .1% NaOH/Water | 22 | 72.2 |
| C31 | B | Y | .228 | .1% NaOH/Water | 22 | 16.8 |
| C32 | C | Y | .329 | .1% NaOH/Water | 22 | 80.9 |
| C33 | D | Y | .161 | .1% NaOH/Water | 22 | 43.3 |
| C34 | G | Y | .149 | .1% NaOH/Water | 22 | 38.5 |
| C35 | H | Y | .154 | .1% NaOH/Water | 22 | 65.8 |
| 15* | E | Y | .182 | .1% NaOH/Water | 22 | 89.3 |
| 16* | I | Y | .237 | .1% NaOH/Water | 22 | 89.7 |
| 17* | M | Y | .207 | .1% NaOH/Water | 22 | 94.4 |
| C36 | A | N | .134 | 1% NaOH/Water | 22 | 90.7 |
| C37 | F | N | .191 | 1% NaOH/Water | 22 | 102.3 |
| C38 | L | N | .190 | 1% NaOH/Water | 22 | 110.1 |
| 18* | E | N | .173 | 1% NaOH/Water | 22 | 103.2 |

Fabric samples were approximately 0.5 grams.
NaOH is weight percent sodium hydroxide solution.
Desizing carried out in caustic and water consecutively.

What is claimed is:

1. A composition which comprises:
   a) from 10 to 90 parts of a poly(vinyl alcohol) polymer which is a poly(vinyl alcohol) copolymer containing from about 7 to 15 weight percent units derived from an alkyl acrylate or methacrylate or a dialkyl fumarate or maleate, wherein the alkyl groups contain from 1 to 8 carbon atoms, and
   b) from 90 to 10 parts of a starch which is a natural starch, a synthetic starch, a physically modified starch or a chemically modified starch.

2. The composition of claim 1 wherein the starch is a natural starch.

3. The composition of claim 1 wherein the poly(vinyl alcohol) polymer is a copolymer containing 7 to 15 weight percent units derived from methyl acrylate.

4. The composition of claim 3 wherein the starch is a natural starch.

5. An improved process for producing woven textiles, comprising:
   a) sizing yarn to be woven with an aqueous solution of the blend of claim 1;
   b) weaving the yarn to produce woven textile;
   c) desizing the woven textile with an aqueous caustic solution having a concentration between 0.001 and 10 weight percent caustic material in water, and
   d) optionally washing the caustic desized woven textile with water.

6. The process of claim 5, wherein the poly(vinyl alcohol) polymer is a copolymer containing 7 to 15 weight percent methyl acrylate, and the caustic material is sodium hydroxide or potassium hydroxide.

7. The process of claim 6 where the caustic solution has a concentration between 0.1 and 1.5 weight percent.

8. The process of claim 5 wherein the starch is a natural starch.

9. The process of claim 7 wherein the starch is a natural starch.

* * * * *